US008381918B2

(12) United States Patent
Johnson

(10) Patent No.: US 8,381,918 B2
(45) Date of Patent: Feb. 26, 2013

(54) SHUFFLING APPARATUSES

(75) Inventor: Rodney G. Johnson, Mudgeeraba (AU)

(73) Assignee: SHFL entertainment, Inc., Las Vegas, NV (US)

( * ) Notice: Subject to any disclaimer, the term of this patent is extended or adjusted under 35 U.S.C. 154(b) by 206 days.

(21) Appl. No.: 12/796,427

(22) Filed: Jun. 8, 2010

(65) Prior Publication Data

US 2010/0244376 A1 Sep. 30, 2010

Related U.S. Application Data

(63) Continuation of application No. 10/663,436, filed on Sep. 15, 2003, now Pat. No. 7,735,657, which is a continuation of application No. 09/919,596, filed on Jul. 31, 2001, now Pat. No. 6,676,127, which is a continuation-in-part of application No. 09/380,943, filed on Sep. 13, 1999, now Pat. No. 6,267,248.

(30) Foreign Application Priority Data

Mar. 13, 1998 (WO) ..... PCT/AU98/00157

(51) Int. Cl.
*A63F 1/12* (2006.01)

(52) U.S. Cl. ..... 209/552; 273/149 R

(58) Field of Classification Search ..... 209/509, 209/546, 547, 552, 644; 235/1 B, 375; 273/149 R, 273/149 P; 194/205; 271/3.15, 3.17; 463/16, 463/22, 47

See application file for complete search history.

(56) References Cited

U.S. PATENT DOCUMENTS

| | | | |
|---|---|---|---|
| 1,885,276 | A | 11/1932 | McKay |
| 2,001,220 | A | 5/1935 | Smith |
| 2,016,030 | A | 10/1935 | Woodruff et al. |
| 2,778,644 | A | 1/1955 | Stephenson |
| 2,950,005 | A | 8/1960 | MacDonald |
| 3,595,388 | A | 7/1971 | Castaldi |
| 3,897,954 | A | 8/1975 | Erickson et al. |
| 4,339,134 | A | 7/1982 | Macheel |
| 4,388,994 | A | 6/1983 | Suda et al. |
| 4,497,488 | A | 2/1985 | Plevyak |
| 4,512,580 | A | 4/1985 | Matviak |
| 4,513,969 | A | 4/1985 | Samsel, Jr. |
| 4,515,367 | A | 5/1985 | Howard |
| 4,534,562 | A | 8/1985 | Cuff |
| 4,586,712 | A | 5/1986 | Lorber |
| 4,659,082 | A | 4/1987 | Greenberg |
| 4,662,637 | A | 5/1987 | Pfeiffer |
| 4,667,959 | A | 5/1987 | Pfeiffer |
| 4,759,448 | A | 7/1988 | Kawabata |
| 4,770,421 | A | 9/1988 | Hoffman |
| 4,807,884 | A | 2/1989 | Breeding |
| 4,832,342 | A | 5/1989 | Plevyak et al. |

(Continued)

FOREIGN PATENT DOCUMENTS

| | | |
|---|---|---|
| WO | WO 87/00764 | 2/1987 |
| WO | WO 00/51076 | 8/2000 |

OTHER PUBLICATIONS

1/3 B/W CCD Camera Module EB100 by EverFocus Electronics Corp.

(Continued)

*Primary Examiner* — Mark Beauchaine
(74) *Attorney, Agent, or Firm* — TraskBritt

(57) ABSTRACT

A card-shuffling device reads a suit and value of individual cards that are moved through a card shuffler. Reading of the cards is effected after the cards have been received into a card holding area and before the cards have been delivered into a card collection area from which cards are removed from the card-shuffling device for use. The read suit and rank are then sent to a processor, wherein the processor identifies whether any playing card is a playing card that should be rejected from the card shuffler and the card shuffler then rejecting that playing card from the playing card shuffler.

20 Claims, 2 Drawing Sheets

U.S. PATENT DOCUMENTS

| | | | | | |
|---|---|---|---|---|---|
| 4,876,000 | A | | 10/1989 | Mikhail | |
| 4,921,109 | A | | 5/1990 | Hasuo et al. | |
| 4,969,648 | A | | 11/1990 | Hollinger et al. | |
| 5,000,453 | A | | 3/1991 | Stevens et al. | |
| 5,121,921 | A | | 6/1992 | Friedman et al. | |
| 5,240,140 | A | | 8/1993 | Huen | |
| 5,248,142 | A | | 9/1993 | Breeding | |
| 5,356,145 | A | | 10/1994 | Verschoor | |
| 5,374,061 | A | | 12/1994 | Albrecht | |
| 5,382,024 | A | | 1/1995 | Blaha | |
| 5,431,399 | A | | 7/1995 | Kelley | |
| 5,575,475 | A | * | 11/1996 | Steinbach | 273/149 R |
| 5,584,483 | A | * | 12/1996 | Sines et al. | 273/149 R |
| 5,605,334 | A | | 2/1997 | McCrea, Jr. | |
| 5,632,483 | A | | 5/1997 | Garczynski et al. | |
| 5,681,039 | A | | 10/1997 | Miller | |
| 5,683,085 | A | | 11/1997 | Johnson et al. | |
| 5,695,189 | A | | 12/1997 | Breeding et al. | |
| 5,722,893 | A | | 3/1998 | Hill et al. | |
| 5,944,310 | A | | 8/1999 | Johnson et al. | |
| 5,989,122 | A | * | 11/1999 | Roblejo | 463/22 |
| 6,039,650 | A | | 3/2000 | Hill | |
| 6,068,258 | A | | 5/2000 | Breeding et al. | |
| 6,117,012 | A | | 9/2000 | McCrea, Jr. | |
| 6,126,166 | A | | 10/2000 | Lorson et al. | |
| 6,149,154 | A | | 11/2000 | Grauzer et al. | |
| 6,213,310 | B1 | | 4/2001 | Wennersten et al. | |
| 6,250,632 | B1 | | 6/2001 | Albrecht | |
| 6,254,096 | B1 | | 7/2001 | Grauzer et al. | |
| 6,267,248 | B1 | | 7/2001 | Johnson et al. | |
| 6,299,536 | B1 | | 10/2001 | Hill | |

OTHER PUBLICATIONS

Specification of Australian Patent Application No. 31577/95 filed Jan. 17, 1995, Applicants: Rodney G. Johnson et al.; Title: Card Handling Apparatus.

Specification of Australian Patent Application No. not listed, filed Aug. 15, 1994, Applicants: Rodney G. Johnson et al.; Title: Card Handling Apparatus.

* cited by examiner

SHUFFLING APPARATUSES

CROSS-REFERENCE TO RELATED APPLICATIONS

This application is a continuation of U.S. patent application Ser. No. 10/663,436, filed Sep. 15, 2003, titled SHUFFLING APPARATUS AND METHOD, now U.S. Pat. No. 7,735,657, issued Jun. 15, 2010, which is a continuation of U.S. patent application Ser. No. 09/919,596, filed Jul. 31, 2001, titled COLLATING AND SORTING APPARATUS, now U.S. Pat. No. 6,676,127, issued Jan. 13, 2004, which, in turn, is a continuation-in-part of U.S. patent application Ser. No. 09/380,943, filed Sep. 13, 1999, now U.S. Pat. No. 6,267,248, issued Jul. 31, 2001, titled COLLATING AND SORTING APPARATUS, which, in turn, is based on PCT Application Serial No. PCT/AU98/00157, filed Mar. 13, 1998 in Australia, which claims priority from Australian Provisional Patent Application No. PO 5640, filed Mar. 13, 1997.

TECHNICAL FIELD

The present invention relates to collation and/or sorting of groups of articles. In particular, this invention relates to shuffling and sorting apparatus for providing randomly collated groups of articles and/or collated groups of articles according to a predetermined order.

The invention can be utilized to collate and sort groups of articles having distinguishing characteristics, which can be machine identified. However, it has particular relevance to shuffling and sorting playing cards and reference will be made hereinafter to such application by way of illustration of the invention.

BACKGROUND

In the gaming industry, many packs of cards are utilized and it is necessary to shuffle one or more decks of cards for game use and/or after each game to sort the cards into one or more packs for re-use either in a specific order or at least into a pack of cards, which is complete. At present, this is achieved manually.

SUMMARY

The present invention aims to provide a collation and/or sorting apparatus, which will operate efficiently and accurately.

With the foregoing in view, the invention in one aspect resides broadly in collation and/or sorting apparatus including sensor means to identify articles for collation and/or sorting; feed means for feeding the articles sequentially past the sensor means; storing means in which articles may be collated in groups in a desired order; selectively programmable computer means coupled to the sensor means and to the storing means to assemble in said storing means groups of articles in a desired order; delivery means for selectively delivering the individual articles into the storing means, and collector means for collecting collated groups of articles. The sensor means may include means to identify the presence of an article. Suitably, the sensor means includes means to identify one or more physical attributes of an article. Preferably, the sensor means includes means to identify indicia on a surface of an article.

The desired order may be a specific order of a set of articles, such as a deck of cards to be sorted into its original pack order, or it may be a random order into which a complete set of articles is delivered from a plurality of sets of randomly arranged articles. For example, the desired order may be a complete pack of playing cards sorted from holding means, which holds a plurality of randomly oriented cards forming a plurality of packs of cards. This may be achieved by identifying the individual cards by optical readers, scanners or any other means and then under control of a computer means such as a microprocessor, or placing an identified card into a specific collector means to ensure delivery of complete decks of cards in the desired order. A random number generator is used to place individual cards into random positions to ensure random delivery of one to eight or more decks of cards. In one aspect, the apparatus is adapted to provide one or more shuffled packs of cards, such as eight packs for the game of baccarat.

The storing means may have individual storing spaces for each respective article to be provided as the collated and/or sorted stack of articles. In such an arrangement, the delivery means delivers identified articles to the respective storing spaces. This may be achieved by arranging the delivery means with travel means movable along a plurality of axes, such as laterally to a column of individual storing spaces and vertically along the column of individual storing spaces.

Preferably, however, the storing means is arranged as one or more rotatable storage magazines, and the delivery means includes a delivery carriage movable to a respective magazine, and drive means for rotating each magazine to operatively align a respective storing space with the delivery carriage.

The collector means may be arranged to receive articles from the storing means as a collated group of articles. For example, the storing means may simultaneously release all the articles therein into the collector means, which may be a confining chute in which the articles settle as a group. Preferably, however, the collector means operates after a complete set of articles has been collated in the storing means and then sequentially feeds the sorted articles into one or more discrete groups.

The sensor means may be any suitable means for identifying a physical characteristic of the articles to be sorted or it may comprise sensor means for detecting and/or interpreting electromagnetic signals reflected and/or transmitted by an article.

One form of the invention is provided as a sorting apparatus for providing a pack of playing cards arranged in original deck order and includes sensor means able to identify the suit and value of individual cards; feed means for feeding the cards sequentially past the sensor means; storing means having individual storing spaces for each respective card of a deck of cards; selectively programmable computer means coupled to the sensor means and the storing means to assemble in the storing means individual cards comprising a complete deck or respective decks of cards; delivery means for delivering the identified cards, or collated decks thereof, to preselected individual storing spaces; and collector means for collecting one or more decks of cards. Another form of the invention comprises a card-shuffling device to randomly shuffle one or more decks of cards.

Preferably, the storing means is arranged as one or more rotatable magazines and the delivery means includes a delivery carriage which receives identified cards from the feed means and is movable along a horizontal drive path in front of a plurality of magazines arranged co-axially and with a common axis parallel to the horizontal drive path and which are rotatable together or independently by the computer means to operatively align a respective storing space with the delivery carriage.

The respective storing spaces may include retention means adapted to captively hold a delivered card therein.

The retention means may comprise a vacuum clamping means, but preferably, the magazine is formed as a quadrant having a lower shroud, which prevents dislodgement of the cards from the storing spaces when in an inverted position.

After collation of one or more decks, the magazine or each magazine may be rotated to sequentially engage retained cards with conveying means which conveys collated decks of cards, which sequentially come into engagement therewith into a collector means.

BRIEF DESCRIPTION OF THE DRAWINGS

In order that the invention may be more readily understood and put into practical effect, reference will be made to accompanying drawings which illustrate schematically one embodiment of a playing card sorting and/or shuffling apparatus, wherein.

DETAILED DESCRIPTION

Figure 1:
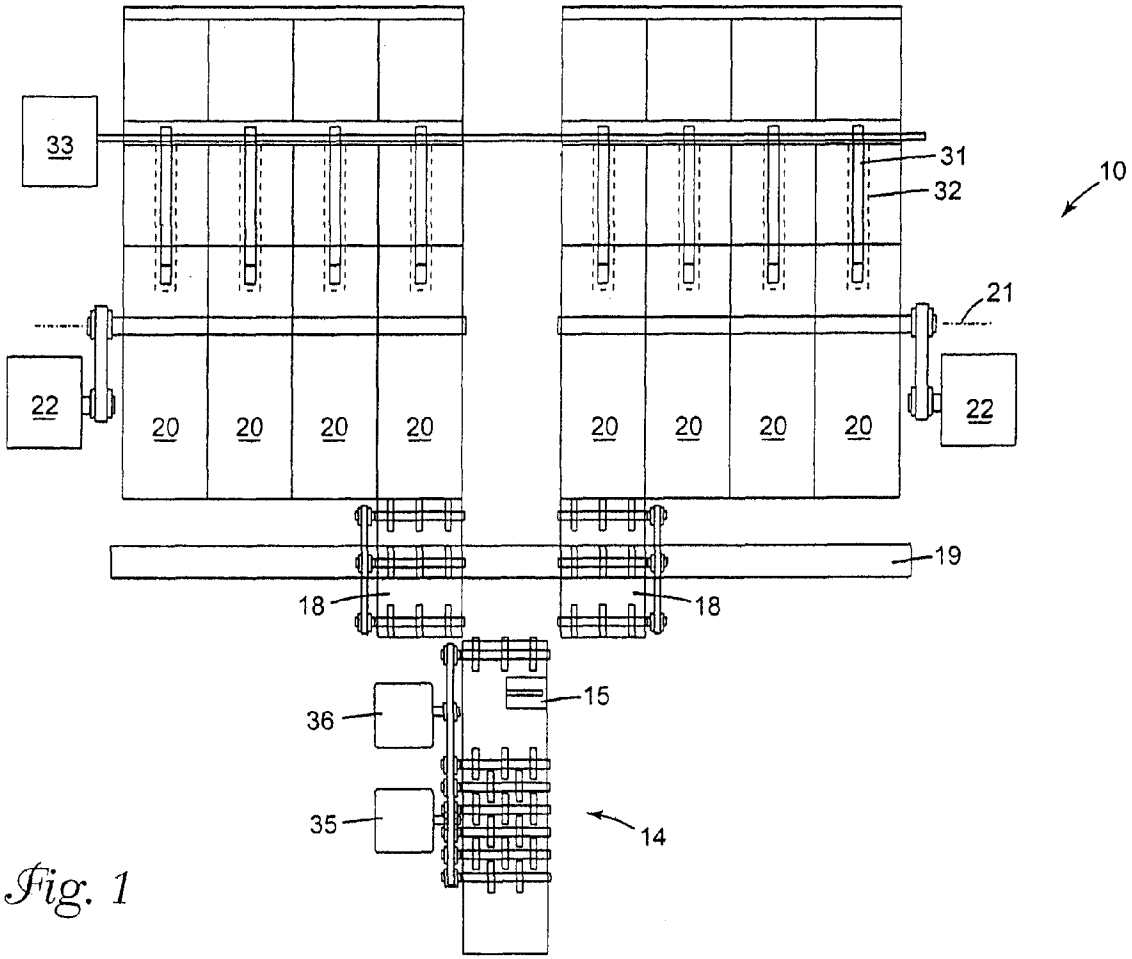
FIG. 1 is a plan view of a shuffling apparatus.
Figure 2:
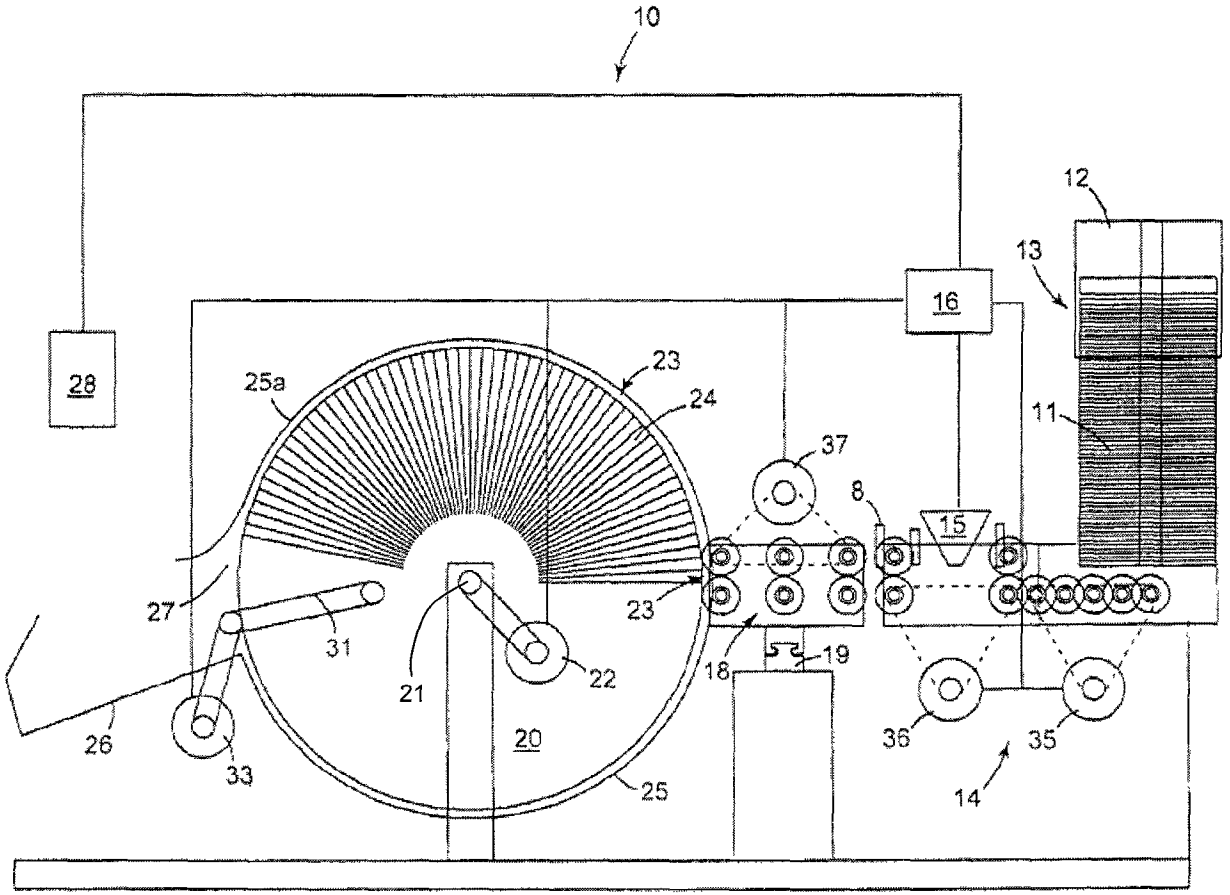
FIG. 2 is a cross-sectional side view of the shuffling apparatus.

FIGS. 1 and 2 depict a collating apparatus 10 for providing sorted and/or shuffled decks of playing cards from a stack of cards 11, which includes holding means 12 for holding the cards in a vertical column 13 above a card feeding means 14, which feeds the lowermost card of the stack past the sensor 15, which is coupled to a microprocessor 16 to record either the presence of a card and/or the identity of a card by its suit and value. Microprocessor 16 is also coupled to drive motors 35, 36 of feeding means 14, respective drive means (not shown) for transverse movement of each delivery carriage 18, card transport drive motor 37 associated with delivery carriages 18, magazine drive motor 22 and drive motor 33 associated with unloading conveyors 31 for selective coordinated operation to collate packs of shuffled or sorted cards.

The feeding means 14 delivers each card past the sensor 15 to a selected one of a pair of delivery carriages 18. Each delivery carriage 18 is movable along a common horizontal track 19, transverse to the direction of movement of the cards from the feeding means 14, and disposed in front of a plurality of card magazines 20 arranged co-axially and with a common axis 21 parallel to the common horizontal track 19. In this embodiment, there are two banks of four magazines 20 arranged in side-by-side relationship at opposite sides of the feeding means 14.

Each bank of magazines 20 is driven by motor 22, which is suitably a reversible stepper motor, or by a motor drive and brake system to achieve selective incremental rotation of magazines 20 to align openings 23 of card storing spaces 24 with delivery carriages 18 to permit a card to be inserted into a respective storing space 24.

A lower shroud 25 extends beneath the respective banks of magazines 20 to maintain the cards in their respective individual storing spaces 24 and an upper shroud 25*a* terminating in outlet port 27 prevents interference with what otherwise would be exposed storing spaces 24 in the upper part of magazine 20. Shroud 25 extends from the delivery carriages 18 to an associated collecting tray 26 adapted to hold respective card packs.

As shown in FIG. 2, there are fifty-six individual storing spaces 24 arranged in an upper sector of the magazine 20 and these radiate outwardly from the axis 21 and fill the space between the outlet port 27, adjacent an unloading conveyor 31, and the output of the delivery carriages 18.

Thus, the drive motor 22 may be actuated to position any one of the fifty-six individual storing spaces 24 in operative alignment with the output of delivery carriages 18, while maintaining the rearmost storing space 24 clear of the unloading conveyor 31.

Individual motors 35 and 36 control the feeding of the cards from the column 13 and from the field of sensor 15 and, further, motors 37 on respective delivery carriages 18 control movement of the cards thereon into the storing spaces 24. A further motor, not illustrated, controls the movement of each delivery carriage 18 and may be a motor driving a transverse screw shaft coupled to the delivery carriages 18 or a belt drive or other means of driving to control transverse travel of each delivery carriage 18.

In a sorting mode, microprocessor 16, or like programmable control means 16, operates to feed cards from the column 13 sequentially past the sensor 15 which identifies each individual card and commits it to memory with an identification, such as a number, which corresponds to the sequentially identified storing spaces 24 of a particular magazine 20. More than one deck of cards can be identified and the program will select between these when sorting. Thus, when the cards are next fed from the column 13 they will be recognized and fed to a corresponding storing space 24 in a respective magazine 20.

Once a storing space 24 is filled the next card so identified will be fed to an allocated storing space 24 in the same magazine 20 unless a card of identical suit and value previously has been identified, in which case, that card is allocated to a respective storing space 24 in one of the other magazines 20. This process is repeated until all cards have been sorted and stored.

Thereafter, the magazines 20 are rotated counter-clockwise as shown toward the unloading conveyors 31 driven in unison by motor 33 until respective conveyors 31 are contacted by the first card in each magazine 20 which card thus will be discharged to the collector tray 26. Unloading conveyors 31 are narrow belts aligned with slotted apertures 32 extending radially of the respective radial walls forming storing spaces 24. The further cards in each magazine will then be sequentially discharged to the collector tray 26 to form packs of sorted cards.

At the end of sorting, if any deck of cards is incomplete or over-supplied, a warning signal will be actuated in association with that deck to indicate the incomplete or oversupplied stack of cards. By actuating a liquid crystal display (LCD) or light-emitting diode (LED) display 28, this will indicate which card is missing or over-supplied and will also then indicate any other deck which is incomplete or over-supplied. The LCD or LED display 28 may, if required, indicate the magazine location in which a card is undersupplied or oversupplied to form a complete deck.

It will be seen that the illustrated collating apparatus 10 may have eight, or more, or less magazines arranged in groups of four, or more, or less with common actuation of the unloading conveyor and separate operation of the motors, which control their pivotal positions.

In a shuffling mode for a single pack of cards, sensor 15 may, or may not, be actuated to detect the suit and value of each card. If it is not required to determine the integrity of a pack of cards other than completeness by counting the number of cards, sensor 15 may be actuable to detect only the presence of a card as it passes from feeding means 14 to delivery carriage 18.

As each card is passed beneath sensor 15, its presence is detected and microprocessor 16, using a random number generator, randomly allocates that card to a predetermined one of the fifty-six storing spaces 24 of magazine 20. Microprocessor 16 then controls drive motors 36, 37 and 22 to effect delivery of the card into the randomly predetermined storing space 24.

When the magazine 20 is full and up to fifty-six cards have been accounted for, magazine 20 is rotated counterclockwise to permit unloading conveyor 31 to discharge a pack of randomly ordered or "shuffled" cards into collector tray 26.

On the other hand, if a multiplicity of decks is to be shuffled for reuse in a game such as baccarat employing like decks of shuffled cards, it may be important to produce eight individually shuffled decks and/or to determine whether cards have been removed or added to the eight-deck stack of cards retrieved from the playing table.

In this case, sensor 15 would be operated to determine not only the presence of a card on the feeding means 14, but also the suit and value of each card to enable loading of the eight magazines 20, each with a randomly ordered or shuffled deck of cards which is otherwise complete.

It will, of course, be realized that while the above has been given by way of illustrative example of this invention, all such other modifications and variations hereto as would be apparent to a person skilled in the art, are deemed to fall within the broad scope and ambit of the invention as is herein set forth.

For example, a reject mechanism 8 may be associated with the sensor 15 to cause duplicate or oversupplied cards to be rejected before delivery by delivery carriages 18 to the magazine 20. The reject mechanism 8 may comprise an electromechanical device or air blast means coupled to the microprocessor 16.

The rotatable magazine 20 may be substituted by a vertically displaceable magazine or any other storage device having a plurality of storage spaces to receive individual cards. Similarly for other applications, the holding means 12 and feeding means 14 may be replaced by a rotary turntable having a selectively actuable finger guide to remove articles from the turntable.

It will be readily apparent to a skilled addressee that the apparatus according to the invention will have an application in the collation and packaging of cards during their manufacture to ensure the integrity of each set of cards produced.

Equally, it will be readily apparent to a skilled addressee that the invention, with suitable modifications, will have wide application in fields where sets of articles are to be collated and bundled in a predetermined order, or in a random order, or otherwise where the grouping or collation of articles by number and/or order is essential.

Such applications may include collation of book pages in the correct order with a mixture of black and white and colored pages from different printing presses; packaging of mixed sets of food items, i.e., breakfast cereal; dispensing and packaging of mixtures of pills for patients on a daily or weekly basis; sorting and packaging of eggs or fruit by size and/or color; sorting and collation of mail by zip code; sorting and collation of bank checks by payee, payer or bank; collation and sorting of bank notes by denomination, condition or integrity, or even sorting and collation of doctors' prescription forms to monitor information on patients, drug prescribed, pharmacy or prescribing doctor.

The present invention is able to collate and/or sort articles by physical attributes such as size, color, shape, mass (e.g., by load cell or the like) or surface indicia or any combination thereof.

What is claimed is:

1. A playing card handling device, comprising:

a playing card holding area and a playing card collecting area;

a magazine configured to temporarily store playing cards between the playing card holding area and the playing card collecting area to form a set of playing cards in the playing card collecting area;

a reject mechanism positioned between the playing card holding area and the magazine, the reject mechanism being configured to reject a playing card before it is delivered to the magazine;

a sensor between the playing card holding area and the playing card collecting area, wherein the sensor is configured to read suit and rank of each playing card between the playing card holding area and the playing card collecting area;

a processor operatively connected to the sensor and the reject mechanism, wherein the processor is configured to receive the read suit and rank information from the sensor;

wherein the processor is programmed to identify whether any playing card is a playing card that should be rejected and to cause the reject mechanism to reject that playing card from the playing card handling device; and a display operatively connected to the processor, the processor being programmed to cause the display to display at least the read suit and rank of each playing card rejected from the playing card handling device.

2. The device of claim 1, wherein the playing card handling device is a playing card shuffler or a playing card collator.

3. The device of claim 2, wherein each read card is moved into a storage space of a plurality of storage spaces in the magazine after reading.

4. The device of claim 2, wherein cards inserted into the magazine are discharged into the card collecting area to form a pack of shuffled cards.

5. The device of claim 2, wherein the processor is programmed with a random number generator to randomly allocate a read card to a storage space of a plurality of storage spaces in the magazine.

6. The device of claim 2, wherein the processor is programmed to sort a read card into a predetermined storage space of a plurality of storage spaces in the magazine.

7. The device of claim 2, wherein the magazine comprises a plurality of magazines.

8. The device of claim 2, wherein the processor is further programmed to cause the display to display the suit and rank of a missing card.

9. The device of claim 2, wherein the processor is further programmed to identify a playing card for rejection by identifying the playing card as an oversupplied card.

10. The device of claim 9, wherein each card is read before being inserted into a storage space of a plurality of storage spaces of the magazine.

11. The device of claim 9, wherein cards inserted into the magazine are discharged into the card collecting area to form a pack of shuffled cards.

12. The device of claim 1, wherein the reject mechanism comprises an air blaster playing card rejector in information communication with the processor.

13. The device of claim 1, wherein the reject mechanism comprises an electromechanical playing card rejector in information communication with the processor.

14. The device of claim 1, wherein cards inserted into the magazine are discharged into the card collecting area to form a pack of shuffled cards.

15. An automatic playing card shuffler, comprising:

a playing card holding area;

a playing card randomization area;

a playing card transfer mechanism that moves cards from the card holding area to the playing card randomization area;

a playing card reading mechanism located between the playing card holding area and the playing card randomization area that is capable of reading rank and suit of playing cards;

a reject mechanism positioned between the playing card holding area and the playing card randomization area, the reject mechanism being configured to reject a playing card before it is delivered to the playing card randomization area; and a display device configured to display rank and suit of playing cards, wherein the reading mechanism is configured to send the suit and rank of playing cards to a processor in information communication with the reading mechanism;

wherein the processor is programmed to identify whether any playing card is a playing card that should be rejected from the card shuffler and to cause the reject mechanism to reject that playing card from the playing card shuffler.

16. The device of claim 15, wherein the display device is selected from the group consisting of an LCD and an LED display.

17. The device of claim 15, wherein the processor is programmed to cause the display device to display rank and suit of each card read by the playing card reading mechanism.

18. An automatic playing card shuffler, comprising:

a playing card infeed area;

a playing card shuffling mechanism;

a shuffled playing card discharge area;

a microprocessor programmed to control operation of the playing card shuffler;

a first playing card feeder that transfers cards from the card infeed area to the playing card shuffling mechanism;

a second playing card feeder that transfers cards from the playing card shuffling mechanism to the shuffled playing card discharge area;

a sensor configured to read rank and suit of playing cards located within the playing card shuffler;

a reject mechanism positioned between the playing card infeed area and the first and second playing card feeders, the reject mechanism being configured to reject a playing card before it is delivered to one of the first and second playing card feeders; and a display unit configured to display rank and suit of playing cards, wherein the sensor is configured to send the read suit and rank of each card to the microprocessor, and wherein the microprocessor is programmed to identify whether any playing card is a playing card that should be rejected from the playing card shuffler and to cause the reject mechanism to reject that playing card from the playing card shuffler.

19. The device of claim 18, wherein the sensor is positioned between the card infeed area and the card shuffling mechanism.

20. The device of claim 18, wherein the processor is configured to cause the display unit to display rank and suit of each card read by the card reading mechanism.

* * * * *